US011945631B2

(12) United States Patent
Cyr et al.

(10) Patent No.: US 11,945,631 B2
(45) Date of Patent: Apr. 2, 2024

(54) BEVERAGE CARRIERS WITH ENVIRONMENTALLY BENEFICIAL FEATURES

(71) Applicants: Aileen Cyr, Creswell, OR (US); Gilles D. Cyr, Creswell, OR (US)

(72) Inventors: Aileen Cyr, Creswell, OR (US); Gilles D. Cyr, Creswell, OR (US)

(73) Assignee: Kadilema S.A. de C.V., Creswell, OR (US)

( * ) Notice: Subject to any disclaimer, the term of this patent is extended or adjusted under 35 U.S.C. 154(b) by 0 days.

(21) Appl. No.: 17/950,686

(22) Filed: Sep. 22, 2022

(65) Prior Publication Data

US 2023/0087274 A1 Mar. 23, 2023

Related U.S. Application Data

(60) Provisional application No. 63/246,986, filed on Sep. 22, 2021.

(51) Int. Cl.
*B65D 71/50* (2006.01)
*B65D 65/46* (2006.01)

(52) U.S. Cl.
CPC ..... *B65D 71/50* (2013.01); *B65D 65/466* (2013.01)

(58) Field of Classification Search
CPC ..... B65D 71/50; B65D 65/466; B65D 71/504
See application file for complete search history.

(56) References Cited

U.S. PATENT DOCUMENTS 2,437,667 A * 3/1948 Leicester ..... B65D 71/50 294/87.26
3,664,497 A * 5/1972 Mascia ..... B65D 17/4012 211/74
3,784,002 A * 1/1974 Owen ..... B65D 71/50 294/87.2
3,868,140 A * 2/1975 Gordon ..... B65D 71/004 206/139
4,156,484 A * 5/1979 Wischusen ..... B65D 71/72 206/565
5,573,111 A * 11/1996 Gordon ..... B65D 71/42 206/151
5,590,776 A * 1/1997 Galbierz ..... B65D 71/44 206/427
5,642,808 A * 7/1997 Marco ..... B65D 71/504 206/428
5,653,334 A * 8/1997 Marco ..... B65D 71/504 294/87.2
5,848,316 A * 12/1998 Clough ..... G03B 17/30 242/348
6,182,821 B1 * 2/2001 Olsen ..... B65D 71/504 206/427
6,702,115 B1 * 3/2004 Roper ..... B65D 5/5061 206/427

(Continued)

*Primary Examiner* — Stephen A Vu
(74) *Attorney, Agent, or Firm* — Mohr Intellectual Property Law Solutions, PC

(57) ABSTRACT

Beverage carriers including a body, a beverage hole, and a slit. The beverage hole is defined in the body and complementarily configured with a beverage container to receive and selectively secure the beverage container. The slit is defined in the body and configured to establish a tear line through the body when the body is pulled in opposing directions proximate the slit.

19 Claims, 11 Drawing Sheets

(56) References Cited

U.S. PATENT DOCUMENTS

| | | | | |
|---|---|---|---|---|
| 7,775,348 | B2 * | 8/2010 | Olsen | B65D 71/504<br>294/87.2 |
| 10,252,835 | B2 * | 4/2019 | O'Donnell | B65D 25/205 |
| 2005/0241963 | A1 * | 11/2005 | Slomski | B65D 71/504<br>206/199 |
| 2018/0362234 | A1 * | 12/2018 | L'Heureux | B65D 71/504 |

* cited by examiner

BEVERAGE CARRIERS WITH ENVIRONMENTALLY BENEFICIAL FEATURES

CROSS REFERENCE TO RELATED APPLICATIONS

This application claims priority to Provisional U.S. Application Ser. No. 63/246,986, filed on Sep. 22, 2021 which is hereby incorporated by reference for all purposes.

BACKGROUND

The present disclosure relates generally to beverage carriers. In particular, beverage carriers with environmentally beneficial features are described.

According to The World Counts webpage, the world's beer and soda consumption currently uses about 180 billion aluminum cans every year. This is 6,700 cans every second, which is enough to go around the planet every 17 hours.

Beverage cans are packaged in various ways, such as corrugated and paperboard boxes and plastic carriers. A large percent of beverage cans are packaged in smaller six packs secured in plastic carriers.

Conventional plastic beverage carriers are not environmentally friendly. Conventional beverage carriers are generally not biodegradable, repulpable, or recyclable. Birds and small animals are often trapped in them with devastating consequences. For economic reasons, consumers in poorer countries are more likely to purchase small sets of beverage cans secured with plastic beverage containers, which contributes to the ongoing worldwide pollution of our land and oceans.

It would be desirable to have a more environmentally friendly beverage carrier that improves upon and advances the design of known beverage carriers. Examples of new and useful beverage carriers relevant to the needs existing in the field are discussed below.

SUMMARY

The present disclosure is directed to beverage carriers. The beverage carriers include a body, a beverage hole, and a slit. The beverage hole is defined in the body and complementarily configured with a beverage container to receive and selectively secure the beverage container. The slit is defined in the body and configured to establish a tear line through the body when the body is pulled in opposing directions proximate the slit.

In some examples, the tear line extends through the beverage hole.

In certain examples, the body defines a finger hole complementarily configured with a finger to facilitate lifting the body. The slit may be defined proximate the finger hole. Further, the slit may extend from the finger hole.

In select examples, the body includes a substrate layer and a film layer disposed on the substrate layer. The substrate layer may include a first major face and a second major face opposite the first major face. The film layer may be disposed on the first major face of the substrate layer. The film layer may also be disposed on the second major face.

In some examples where the body includes a substrate layer, the substrate layer is comprised of paper. The substrate layer may be biodegradable. The substrate layer may be configured to be pulped repeatedly. The substrate layer may have a weight attribute range of 40 to 65 lbs.

In certain examples where the body includes a film layer, the film layer may be water soluble between 0 and 100 degrees Celsius. The film layer may be comprised of polyvinyl alcohol. In select examples, the slit is defined exclusively in the film layer.

In particular examples, the body includes an indicator indicating where a user should selectively tear the body. The indicator may be coincident with the slit. The indicator may be an arrow with a line portion and an arrowhead. The slit may be aligned with the line portion of the arrow.

In some examples, the beverage carrier includes a handle operatively connected to the body to facilitate carrying the beverage carrier. The handle may be selectively removeable from the body. Alternatively, the handle may be fixed to the body.

DETAILED DESCRIPTION

Figure 1:
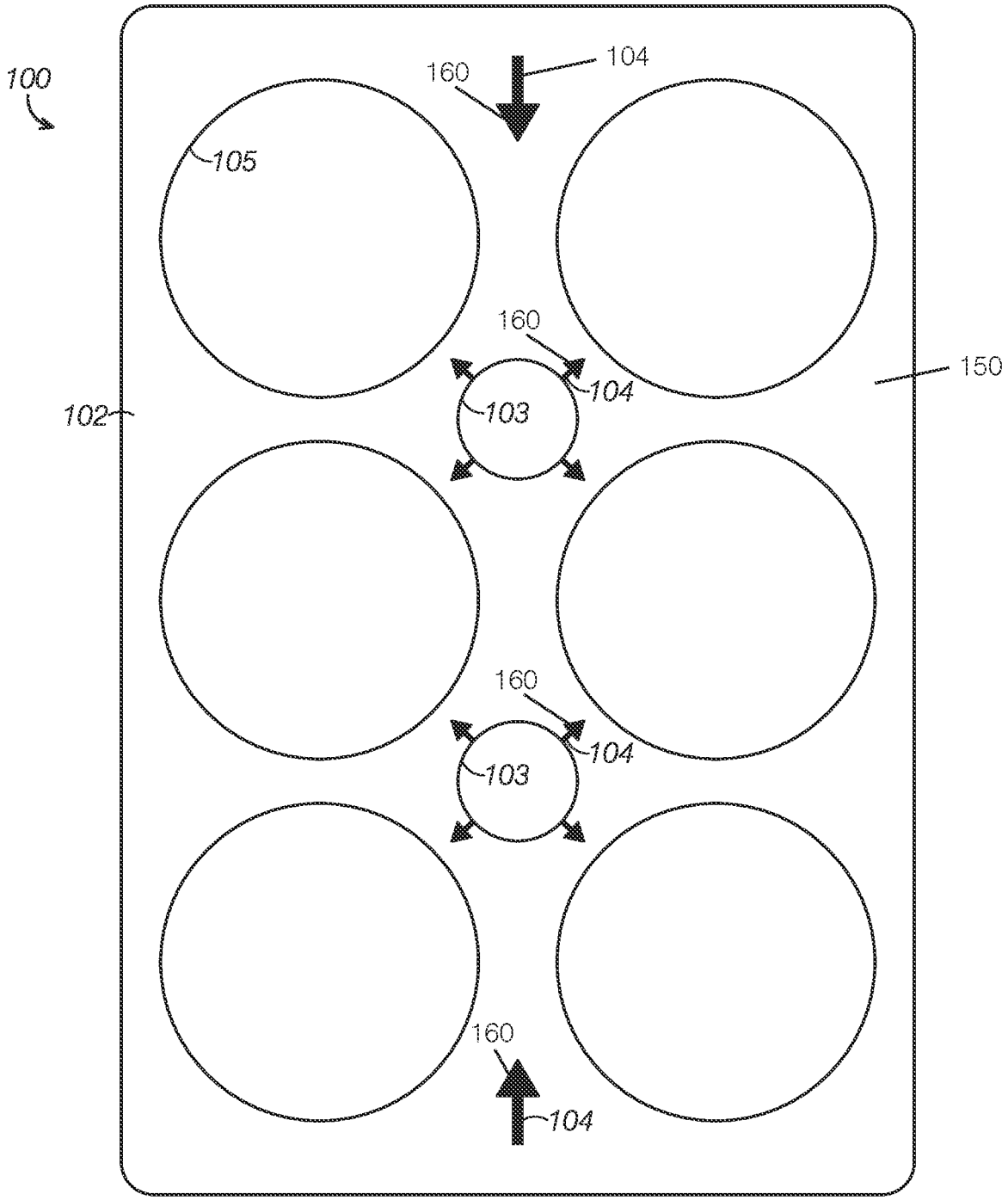
FIG. 1 is a top plan view of a first embodiment of a beverage carrier.

The disclosed beverage carriers will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, a variety of beverage carrier examples are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

Definitions

The following definitions apply herein, unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first", "second", and "third" are used to distinguish or identify various members of a group, or the like, and are not intended to denote a serial, chronological, or numerical limitation.

"Coupled" means connected, either permanently or releasably, whether directly or indirectly through intervening components.

Beverage Carriers with Environmentally Beneficial Features

With reference to the figures, beverage carriers with environmentally beneficial features will now be described. The beverage carriers discussed herein function to secure sets of beverage cans.

The reader will appreciate from the figures and description below that the presently disclosed beverage carriers address many of the shortcomings of conventional beverage carriers. For example, the novel beverage carriers discussed below are biodegradable, can be pulped repeatedly, and can be recycled. Further, the novel beverage carriers discussed herein include features to avoid animals becoming trapped in them. Moreover, the novel beverage carriers discussed in this application are well suited to securing small sets of beverage cans popular throughout the world, including in poor countries.

Contextual Details

Ancillary features relevant to the beverage carriers described herein will first be described to provide context and to aid the discussion of the beverage carriers.

Beverage Can

The beverage carriers disclosed herein are used to secure beverage cans, such as beverage cans 101 depicted in the figures. Beverage cans function to contain a beverage in a sealed configuration until selectively opened to dispense or consume the beverage.

The beverage carriers may be adapted to secure any currently known or later developed type of beverage can. The beverage cans may be a variety of shapes and sizes, but are typically cylindrical in standard sizes. Beverage containers are typically made of aluminum, but the beverage carriers discussed below may be used with beverage cans made from any currently known or later developed material.

Beverage Carrier Embodiment One

Figure 2:
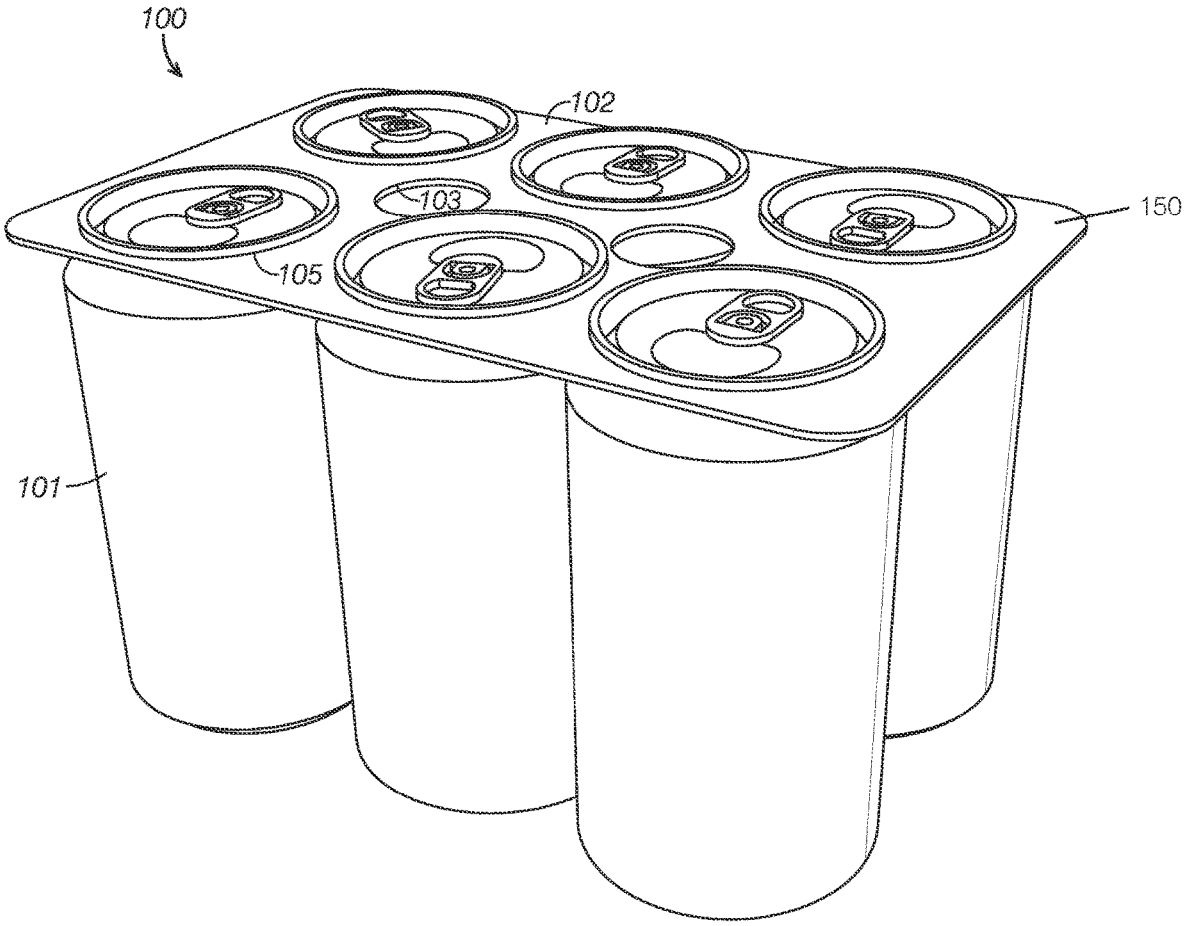
FIG. 2 is a perspective view of the first embodiment beverage carrier securing beverage cans.

With reference to FIGS. 1-4 and 11, a first example of a beverage carrier, beverage carrier 100, will now be described. As shown in FIG. 2, beverage carrier 100 functions to support beverage cans 101. Beverage carrier 100 includes environmentally friendly features, including slits 104 to facilitate tearing, a biodegradable composition, and a composition that can be pulped repeatedly. Slits 104 are shown in FIGS. 1-4 and 11 and described in more detail below.

In the example shown in FIGS. 1-4 and 11, beverage carrier 100 includes a body 102, beverage holes 105, and slits 104. In some examples, such as shown in FIGS. 5-10, the beverage carrier includes additional or alternative features, such as a handle.

Body

As shown in FIG. 2, body 102 functions to support beverage cans 101. Further, as shown in FIGS. 1-4 and 11, body 102 defines features to facilitate using beverage carrier 100.

For example, as shown in FIGS. 1-4 and 11, body 102 defines finger holes 103, slits 104, and beverage holes 105. Further shown in FIGS. 1, 3, and 4 (omitted from FIG. 2 for clarity), body 102 displays indicators 160. Finger holes 103 facilitate a user grasping and lifting beverage carrier 100. Slits 104 enable tearing body 102 when beverage carrier 100 is no longer needed to support beverage cans 101. Indicators 160 indicate where a user should initiate selectively tearing body 102.

Figure 11:
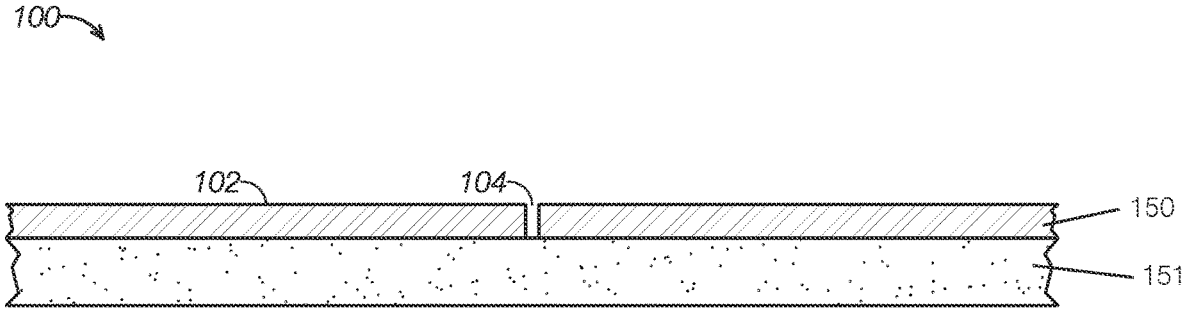
FIG. 11 is a close-up view of a cross section through the body shown in FIG. 1 depicting a slit formed exclusively in a film layer.

In the example shown in FIGS. 1-4 and 11, body 102 includes a substrate layer 151 (sometimes referred to as a paper layer) and a film layer 150. With reference to FIG. 11, the reader can see that film layer 150 is disposed on substrate layer 151. With continued reference to FIG. 11, it is apparent that slit 104 is formed exclusively in film layer 150.

Body 102 depicted in FIGS. 1-4 and 11 has dimensions of 5"×7.5" (12.7 cm×19.05 cm). In other examples, the body has different dimensions. The dimensions may be selected to suit the needs of a given beverage can and storage or shipping configuration.

In the present example, body 102 is die cut. However, the body may be formed by any currently known or later developed processing method suitable for forming the features of the body.

Substrate Layer

Substrate layer 151 provides structural integrity for body 102 while concurrently allowing body 102 to be selectively torn. As shown in FIG. 11, substrate layer 151 supports film layer 150.

With continued reference to FIG. 11, the reader can see that substrate layer 151 includes a first (top) major face and a second (bottom) major face opposite the first major face. Substrate layer 151 is configured to be pulped repeatedly.

In the present example, substrate layer 151 is formed from paper with a weight attribute range of 40 to 65 lbs (150 to 176 g/m$^2$). Significantly higher and lower weight attributes are suitable for the substrate layer as well. Higher weight attribute paper may potentially increase processing effort, increase cost, and/or lower elongation.

The paper can be in a natural state, printed upon with indicia, text, or designs, or in various colors for marketing or other practical reasons. Any currently known or later developed style of paper may be used.

Film Layer

Film layer 150 increases the structural integrity of body 102 and facilitates selectively tearing body 102 via slits 104. As shown in FIG. 11, film layer 150 is disposed on substrate layer 151. Film layer 150 adds flexibility, elongation, and tensile strength to the paper layer for proper processing.

In the present example, film layer 150 is disposed on the first major face of substrate layer 151 on the top of body 102. In other examples, the film layer is disposed on both the first and second major faces of the substrate layer. The film layer may coat the substrate layer or be laminated to the substrate layer via an adhesive, heat, vacuum, or other fusing process. In some examples, the film layer is impregnated into the substrate layer.

The film layer thickness may be selected to suit the needs of a given beverage carrier application. The film can be transparent, translucent, colored, or printed upon with indicia, text, or designs.

In the example shown in FIGS. 1-4 and 11, film layer 150 is a water soluble film. In particular, the water soluble film is polyvinyl alcohol. However, the film layer may be composed of any water soluble film currently known or later developed. The film being water soluble facilitates it biodegrading when discarded. Film layer 150 is selected to be soluble in water within any temperature between 0 and 100 degrees Celsius.

Finger Holes

Finger holes 103 facilitate lifting beverage carrier with one's fingers. In the example shown in FIGS. 1-4, finger holes 103 are circular, but may be any shape suitable for inserting one's finger or fingers. Finger holes 103 are 0.75" (1.9 cm) in diameter and may be larger or smaller in other examples.

As shown in FIG. 1, body 102 defines two finger holes 103. In other examples, the body may define more than two finger holes, a single finger hole, or may not define a finger hole.

Slits

Slits 104 are formed in film layer 150 to facilitate tearing body 102 when beverage carrier 100 is no longer needed to support beverage cans 101. Slits 104 are formed only in film layer 150 to facilitate selectively tearing body 102 when desired while maintaining the structural integrity of body 102 until a tear is desired. Tearing occurs when a user selectively pulls body 102 in opposing directions proximate slit 104.

Slits 104 in film layer 150 initially constrain tears from selective tearing forces to portions of substrate layer 151 underlying slits 104. With continued tearing force, slits 104 establish a tear line beyond slits 104. The selective tear extends beyond slit 104 when the user selectively tears body 102 and tears both substrate layer 151 and film layer 150.

Figure 3:
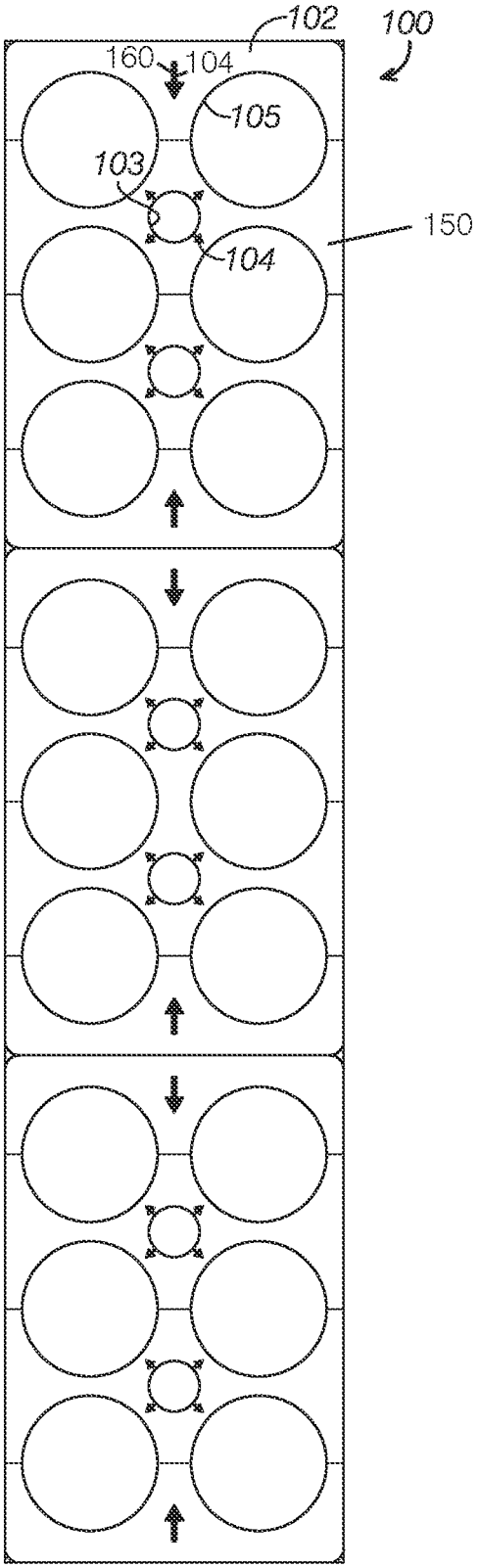
FIG. 3 is a top plan view of a sheet of the beverage carriers shown in FIG. 2.
Figure 4:
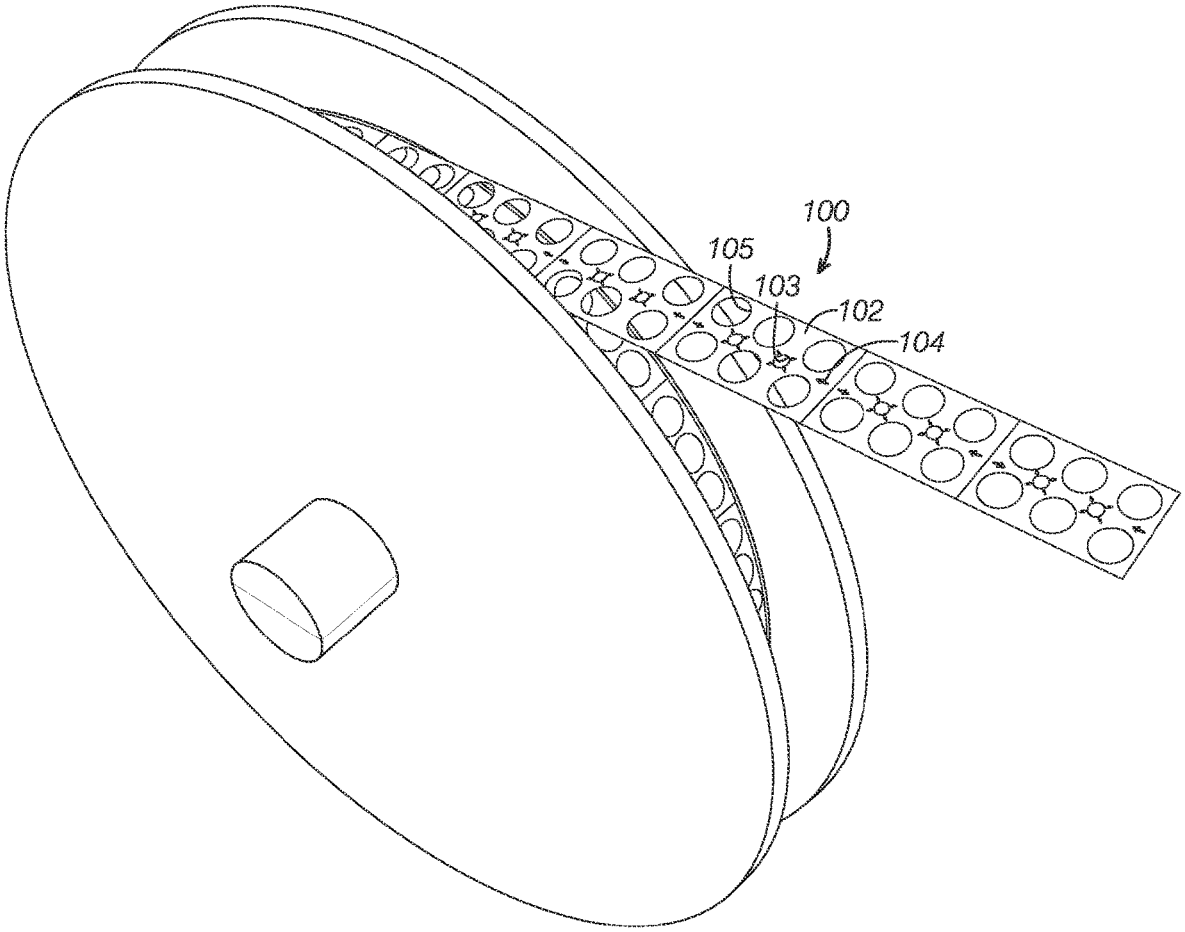
FIG. 4 is a perspective view of a roll of the sheet of beverage carriers shown in FIG. 3.
Figure 5:
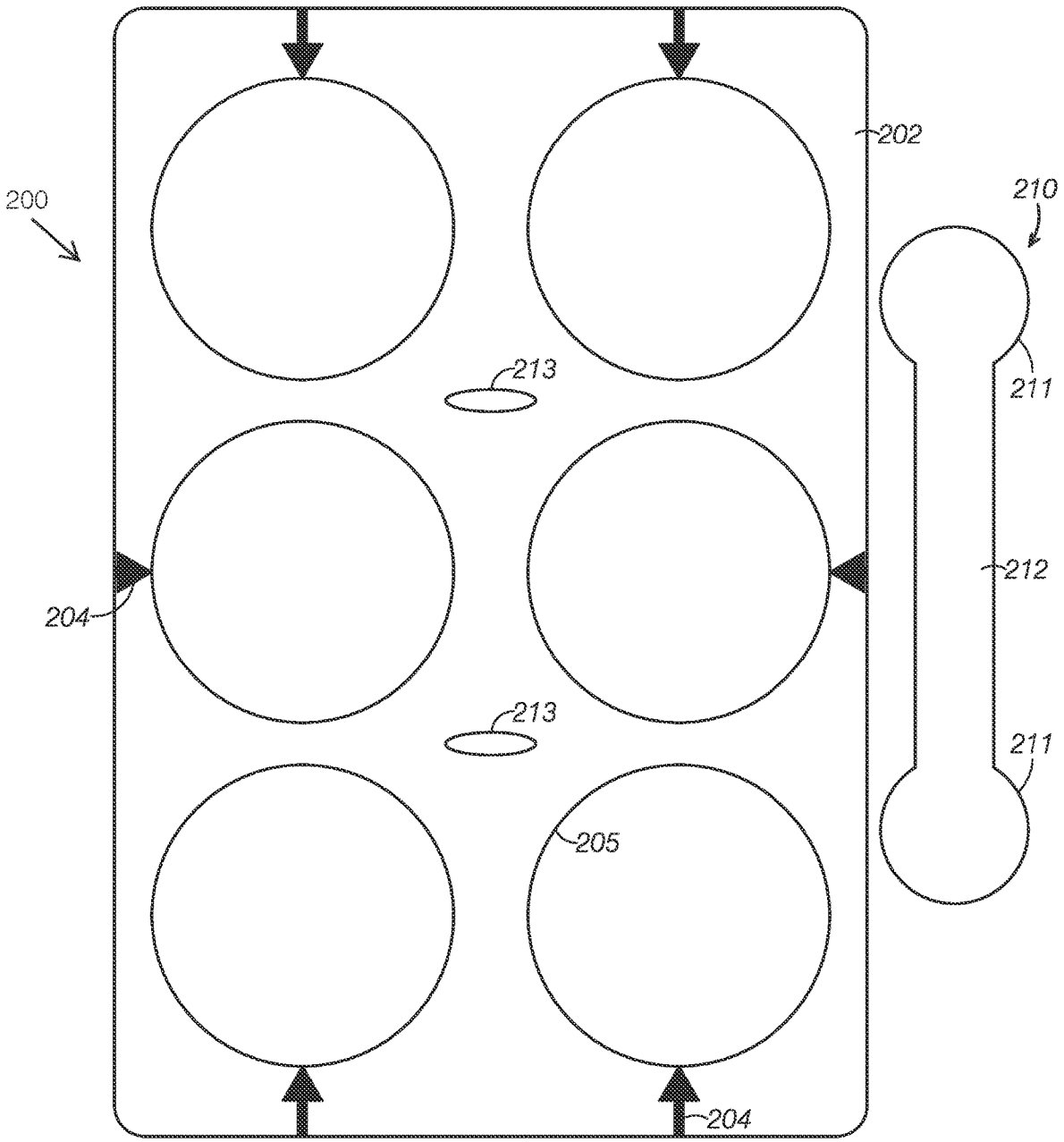
FIG. 5 is a top plan view of a second embodiment of a beverage carrier.
Figure 6:
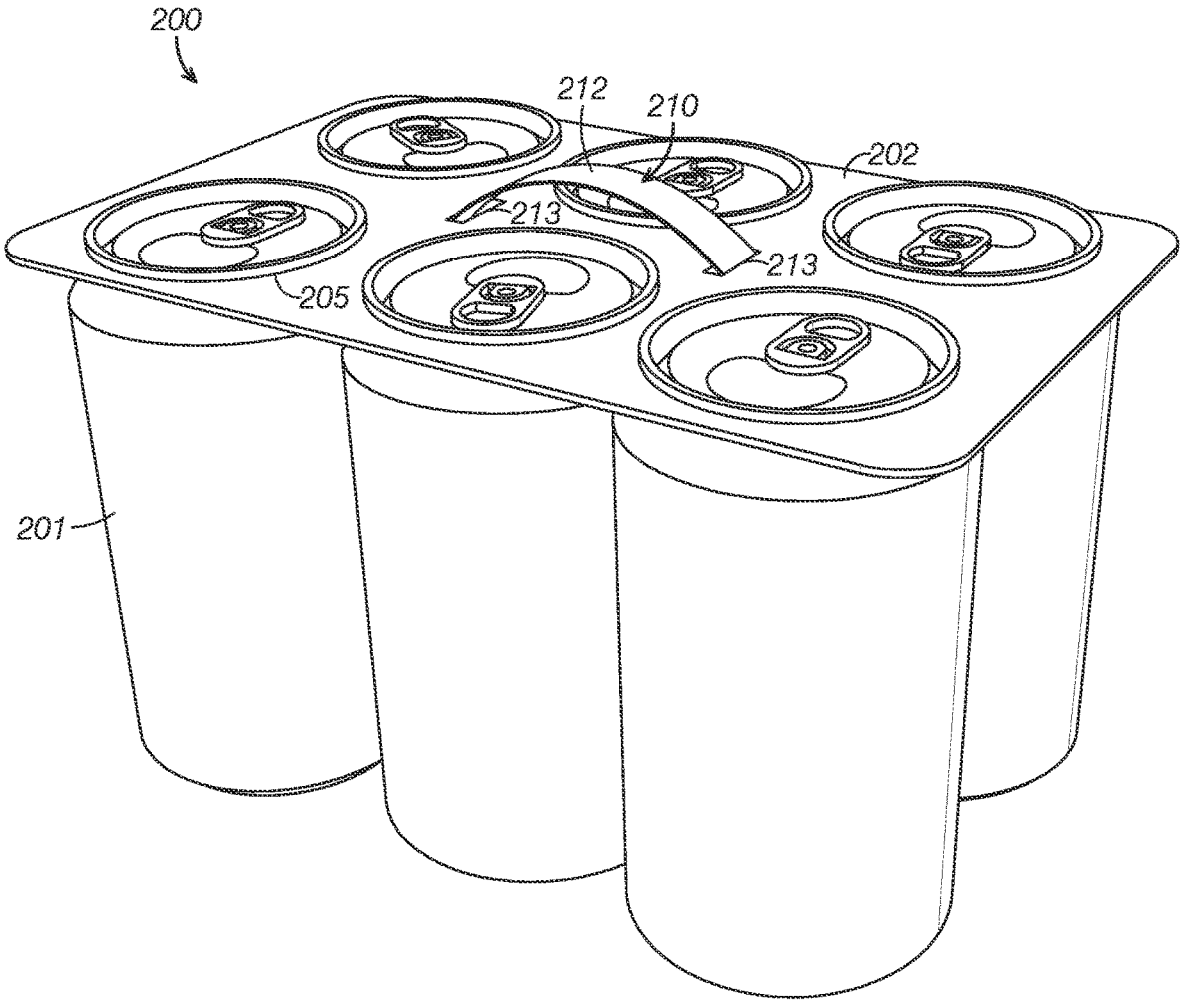
FIG. 6 is a perspective view of the second embodiment beverage carrier securing beverage cans.
Figure 7:
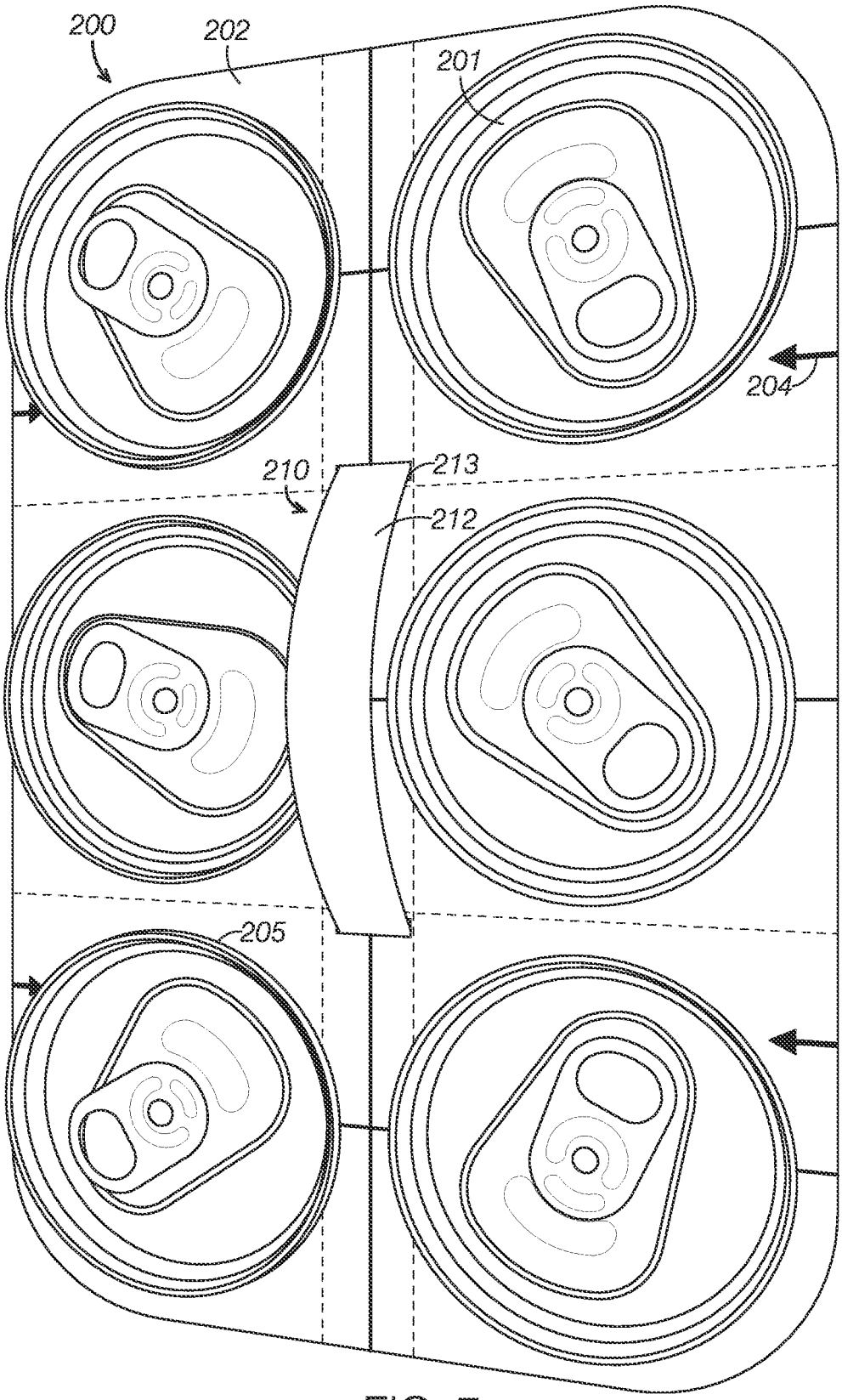
FIG. 7 is a top perspective view of the second embodiment beverage carrier securing beverage cans.
Figure 8:
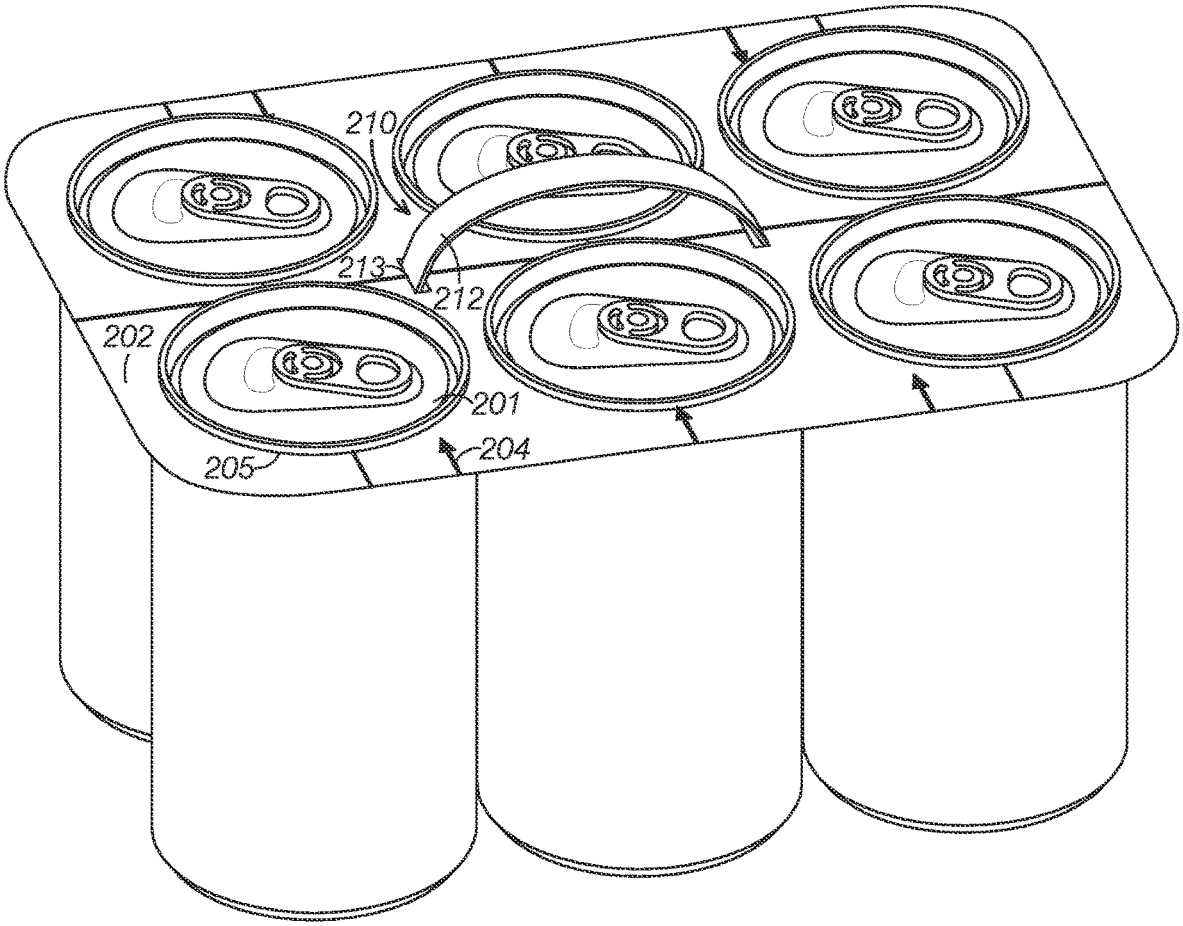
FIG. 8 is a side perspective view of the second embodiment beverage carrier securing beverage cans.

As shown in FIGS. 1, 3, and 4, slits 104 may be oriented to establish tear lines extending through beverage holes 105 and finger holes 103. For example, tear lines extending from slits 104 originating and extending outwards from finger holes 103 extend through beverage holes 105. Tear lines extending from slits 104 extending along the midline of body 102 (denoted by the two large arrows 160 pointing up and down in FIG. 1) extend through finger holes 103. Extending tears through beverage holes 105 and/or finger holes 103 may reduce the risk of wildlife becoming entrapped in the openings.

There are 10 slits 104 in the example of body 102 depicted in FIG. 1, but the body may include additional or fewer slits in other examples. In the present example, slits 104 coincide with the back of the arrows (indicators 160) depicted on the top face of body 102, including sets of four slits 104 extending outwards from finger holes 103 and two slits 104 extending along the midline of body 102. However, the slits may be disposed in any suitable location that facilitates selectively tearing body 102.

In the present example, slits 104 are 0.25 mm in dimension. However, the slits may be larger or smaller in other examples.

Beverage Holes

Beverage holes 105 function to receive and carry beverage cans 101. As shown in FIG. 2, beverage holes 105 are complementarily configured with beverage containers 101 to receive and selectively secure beverage containers 101.

In the present example, beverage holes 105 are 2.00" (5.08 cm) in diameter. However, the beverage holes may be any size and shape suitable to receive and carry a given beverage can.

Indicators

As shown in FIGS. 1 and 3, indicators 160 function to indicate where a user should selectively tear body 102. In the present example, indicators 160 depict arrows with slits 104 formed in the line portion of the arrow. However, any suitable indicator shape or style may be used.

In the example shown in FIGS. 1 and 3, indicators 160 depict the intended tear line direction with arrowheads pointing in the direction the tear should be propagated. The reader can see in FIGS. 1 and 3 that indicators 160 are coincident with slits 104. In particular, slits 104 are formed along and aligned with the line portion of the arrow defined by indicator 160. As explained above, slits 104 serve to localize and direct the tear. The user can selectively continue the tear along the tear line direction indicated by indicator 160 by pulling body 102 in opposing directions.

Additional Embodiments

The discussion will now focus on additional beverage carrier embodiments. The additional embodiments include many similar or identical features to beverage carrier 100. Thus, for the sake of brevity, each feature of the additional embodiments below will not be redundantly explained. Rather, key distinctions between the additional embodiments and beverage carrier 100 will be described in detail and the reader should reference the discussion above for features substantially similar between the different beverage carrier examples.

Second Embodiment

Turning attention to FIGS. 5-8, a second example of a beverage carrier, beverage carrier 200, will now be described. As can be seen in FIGS. 5-8, beverage carrier 200 includes a body 202 and a handle 210. Body 202 defines slits 204 and beverage holes 205.

The main distinction between beverage carrier 200 and beverage carrier 100 is handle 210. Handle 210 facilitates carrying beverage carrier 200 conveniently when beverage carrier is securing beverage cans 201. As can be seen in FIGS. 5-8, handle 210 includes lobes 211 extending from a grip 212.

Grip 212 is configured to be grasped by a user's hand and lobes 211 are configured to selectively couple to body 202. Body 202 defines handle openings 213 configured to receive lobes 211. Lobes 211 are complementarily configured with handle openings 213 to selectively insert through handle openings 213 when temporarily folded slightly to decrease their width and to restrict lobes 211 from retracting from handle openings 213 when lobes 211 are unfolded to their full width.

When lobes 211 are restricted from passing through handle openings 213, handle 210 remains coupled to body 202. Handle 210 may be selectively decoupled from body 202 when lobes are selectively bent slightly to decrease their width sufficient to pass through handle openings 213 in body 202.

Third Embodiment

Figure 9:
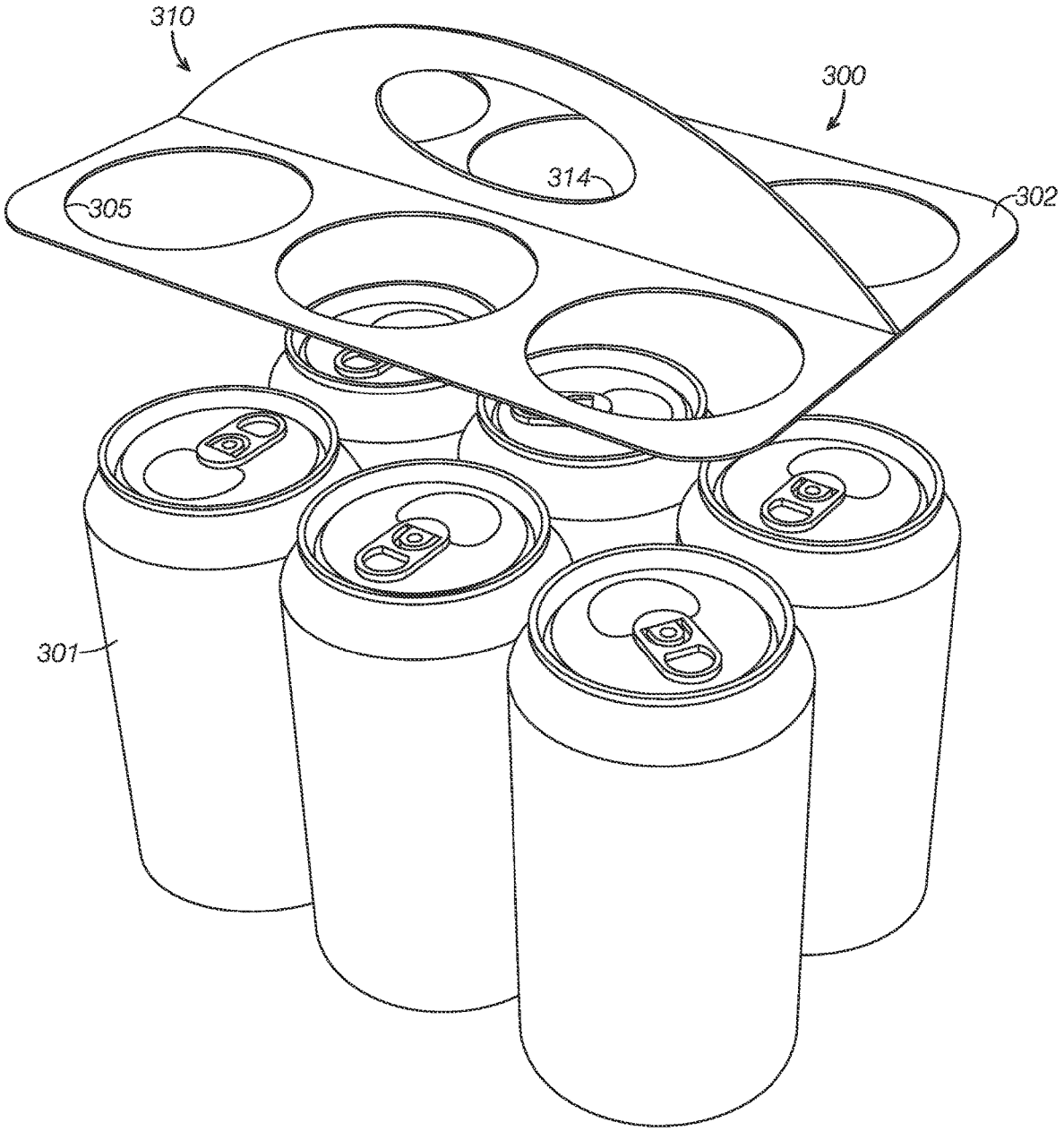
FIG. 9 is a perspective view of a third embodiment beverage carrier securing beverage cans.
Figure 10:
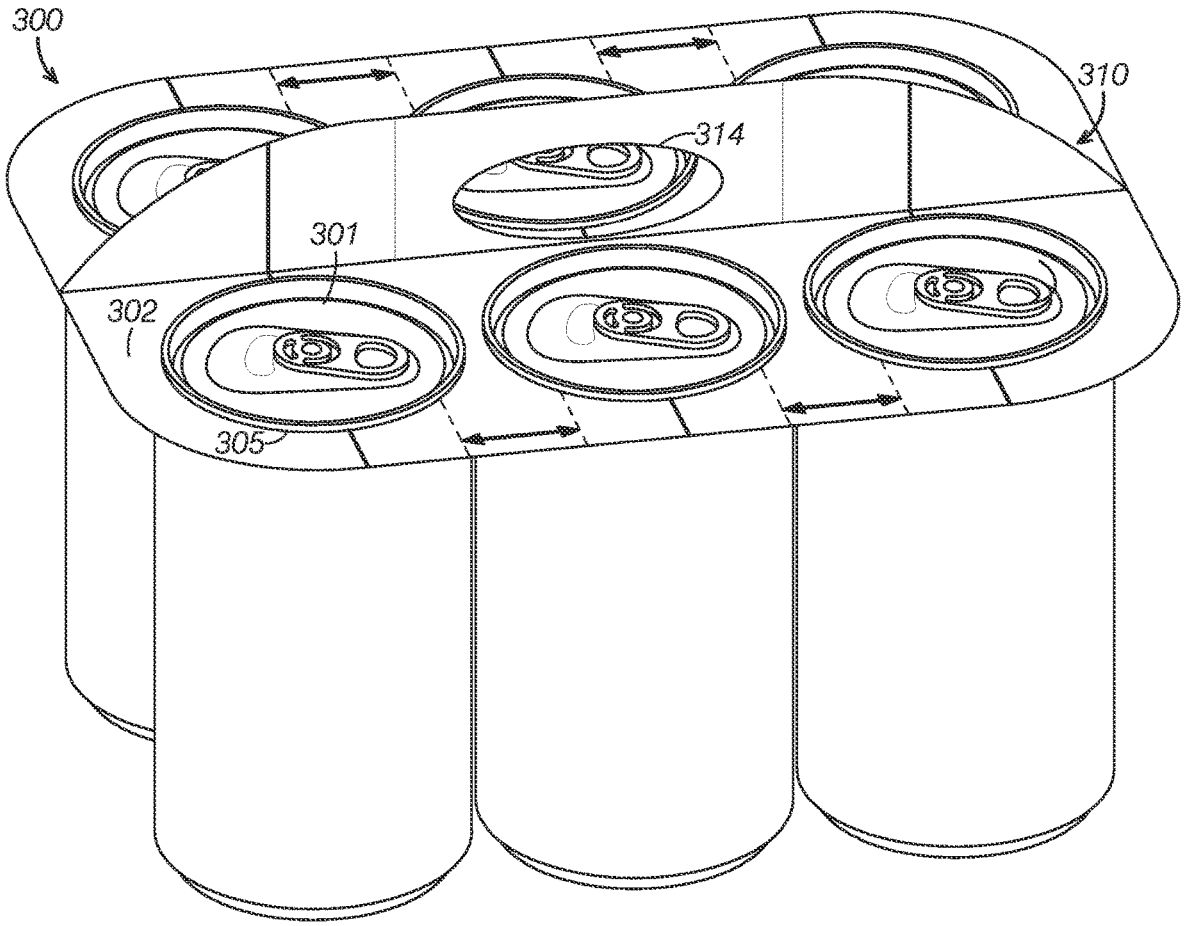
FIG. 10 is a perspective view of the third embodiment beverage carrier securing beverage cans.

Turning attention to FIGS. 9 and 10, a third example of a beverage carrier, beverage carrier 300, will now be described. As can be seen in FIGS. 9 and 10, beverage carrier 300 includes a body 302 and a handle 310. Body 302 defines beverage openings 305.

The main distinction between beverage carrier 300 and beverage carrier 100 is handle 310, which is fixed to body 302. Handle 310 facilitates carrying beverage carrier 300 when beverage carrier is securing beverage cans 301. As can be seen in FIGS. 9 and 10, handle 310 defines a grip opening 314 through which a user my insert fingers to more effectively grasp handle 310.

In the example shown in FIGS. 9 and 10, handle 310 extends transverse to a major face of body 302. In particular, handle 310 is disposed along a midline of the major face of body 302. However, the handle may be disposed in other positions on the body in other examples.

In the present example, handle 310 is configured to selectively fold flat for compact storage and transport and to selectively fold upright to be used. In other examples, the handle is configured to remain upright without folding between stowed and use configurations. The reader can see in FIGS. 9 and 10 that handle 310 has a curved ridge, but the ridge may be flat in other examples.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and noni-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A beverage carrier, comprising:
a body;
a beverage hole defined in the body, the beverage hole being complementarily configured with a beverage container to receive and selectively secure the beverage container; and
a slit defined in the body;
wherein the slit is configured to establish a tear line through the body when the body is pulled in opposing directions proximate the slit
wherein the body includes:
a substrate layer selected to support the weight of the beverage container without tearing along the tear line and to selectively tear when the body is pulled in opposing directions proximate the slit; and
a film layer disposed on the substrate layer.

2. The beverage carrier of claim 1, wherein the tear line extends through the beverage hole.

3. The beverage carrier of claim 1, wherein the body defines a finger hole adapted for a finger to facilitate lifting the body.

4. The beverage carrier of claim 3, wherein the slit is defined proximate the finger hole.

5. The beverage carrier of claim 4, wherein the slit extends from the finger hole.

6. The beverage carrier of claim 1, wherein:
the substrate layer includes a first major face and a second major face opposite the first major face; and
the film layer is disposed on the first major face of the substrate layer.

7. The beverage carrier of claim 6, wherein the film layer is disposed on the top of the body.

8. The beverage carrier of claim 1, wherein the substrate layer is comprised of paper.

9. The beverage carrier of claim 8, wherein the substrate layer is biodegradable.

10. The beverage carrier of claim 8, wherein the substrate layer is configured to be pulped repeatedly.

11. The beverage carrier of claim 8, wherein the substrate layer has a weight attribute range of 40 to 65 lbs.

12. The beverage carrier of claim 1, wherein the film layer is water soluble between 0 and 100 degrees Celsius.

13. The beverage carrier of claim 12, wherein the film layer is comprised of polyvinyl alcohol.

14. The beverage carrier of claim 1, wherein the slit is defined exclusively in the film layer.

15. The beverage carrier of claim 1, wherein:
the body includes an indicator indicating where a user should selectively tear the body; and
the indicator is coincident with the slit.

16. The beverage carrier of claim 15, wherein:
the indicator is an arrow with a line portion and an arrowhead; and
the slit is aligned with the line portion of the arrow.

17. The beverage carrier of claim 1, further comprising a handle operatively connected to the body to facilitate carrying the beverage carrier.

18. The beverage carrier of claim 17, wherein the handle is selectively removeable from the body.

19. A beverage carrier, comprising:
a body including:
a biodegradable substrate layer having a top surface; and
a film layer in the form of a water soluble coating applied on to the top surface of the biodegradable substrate layer;
a beverage hole defined in the body, the beverage hole being complementarily configured with a beverage container to receive and selectively secure the beverage container; and
a slit defined exclusively in the film layer;
wherein:
the slit is configured to establish a tear line through the biodegradable substrate when the body is pulled in opposing directions proximate the slit;
the tear line extends through the beverage hole; and
the biodegradable substrate is selected to support the weight of the beverage container without tearing along the tear line and to selectively tear when the body is pulled in opposing directions proximate the slit.

* * * * *